US008051831B2

(12) United States Patent
Urushihata

(10) Patent No.: US 8,051,831 B2
(45) Date of Patent: Nov. 8, 2011

(54) CONTROL DEVICE FOR VARIABLE VALVE TIMING APPARATUS

(75) Inventor: Haruyuki Urushihata, Chiryu (JP)

(73) Assignee: Denso Corporation, Kariya (JP)

( * ) Notice: Subject to any disclaimer, the term of this patent is extended or adjusted under 35 U.S.C. 154(b) by 460 days.

(21) Appl. No.: 12/418,872

(22) Filed: Apr. 6, 2009

(65) Prior Publication Data

US 2009/0265077 A1 Oct. 22, 2009

(30) Foreign Application Priority Data

Apr. 16, 2008 (JP) ..... 2008-106909

(51) Int. Cl.
*F02D 13/04* (2006.01)

(52) U.S. Cl. ..... 123/321; 123/90.15

(58) Field of Classification Search ..... 123/321, 123/322, 345–348, 90.1, 90.15–90.17, 179.16
See application file for complete search history.

(56) References Cited

U.S. PATENT DOCUMENTS 6,755,165 B2 * 6/2004 Kondou et al. ..... 123/90.17
7,004,128 B2 * 2/2006 Majima et al. ..... 123/90.17
7,287,500 B2 * 10/2007 Izumi et al. ..... 123/179.18
7,661,403 B2 * 2/2010 Izumi ..... 123/179.16
2005/0211207 A1 9/2005 Urushihata et al.
2006/0042579 A1 3/2006 Izumi et al.
2006/0260573 A1 11/2006 Urushihata et al.
2009/0125215 A1 * 5/2009 Blom ..... 701/105

FOREIGN PATENT DOCUMENTS

JP 2001-082190 3/2001

* cited by examiner

*Primary Examiner* — John Kwon
(74) *Attorney, Agent, or Firm* — Nixon & Vanderhye PC

(57) ABSTRACT

A control device for a variable valve timing apparatus that changes valve timing of at least one of an intake valve and an exhaust valve of an internal combustion engine includes an actual valve timing computing unit and a valve timing controlling unit. The actual valve timing computing unit computes actual valve timing. The valve timing controlling unit controls the variable valve timing apparatus to maintain present valve timing during starting of the internal combustion engine before the actual valve timing computing unit becomes capable of computing the actual valve timing. The valve timing controlling unit controls the variable valve timing apparatus such that the actual valve timing becomes target valve timing during the starting of the internal combustion engine after the actual valve timing computing unit becomes capable of computing the actual valve timing.

17 Claims, 7 Drawing Sheets

CONTROL DEVICE FOR VARIABLE VALVE TIMING APPARATUS

CROSS REFERENCE TO RELATED APPLICATION

This application is based on and incorporates herein by reference Japanese Patent Application No. 2008-106909 filed on Apr. 16, 2008.

BACKGROUND OF THE INVENTION

1. Field of the Invention

The present invention relates to a control device for a variable valve timing apparatus that changes valve timing of at least one of an intake valve and an exhaust valve of an internal combustion engine.

2. Description of Related Art

Recently, more and more internal combustion engines of vehicles are provided with a variable valve timing apparatus that changes valve timing of an intake valve and an exhaust valve in order to increase the output, to improve fuel efficiency, or to reduce exhaust gas emission. Presently, actually used variable valve timing apparatuses are configured such that a rotational phase (camshaft phase) of a camshaft relative to a crankshaft is changed in order to change valve timing of the intake valve and the exhaust valve opened and closed by the camshaft. Actual valve timing (actual camshaft phase) is computed based on a crank angle signal outputted by a crank angle sensor and a cam angle signal outputted by a cam angle sensor during the operation of the internal combustion engine. Then, the variable valve timing apparatus is controlled such that the actual valve timing becomes target valve timing.

Also, JP-A-2001-82190 describes a technique, in which valve timing or the camshaft phase is forcibly changed to a limit position (for example, a full retard position) within a mechanically-movable range of the variable valve timing apparatus in order to correct computation error of the actual valve timing caused by manufacturing variations and aged deterioration of the variable valve timing apparatus. Then, a reference position for the valve timing is learned in the above forcibly changed situation, and then the actual valve timing is computed by referring to the learned reference position. For example, the actual valve timing on the basis of the learned reference position corresponds to an advance amount from the reference position (full retard position).

During starting of the internal combustion engine, the crank angle sensor outputs crank angle signals, and also the cam angle sensor outputs cam angle signals after the cranking of the engine has been started. However, before the cam angle sensor starts outputting the cam angle signals, the computation of the actual valve timing cannot be started disadvantageously because the actual valve timing is computed based on the output signals outputted from the crank angle sensor and the cam angle sensor.

As the countermeasure for the above disadvantages, the inventor of the present invention has been studying a system for obtaining the actual valve timing in an alternative method. More specifically, in the motor-actuated variable valve timing apparatus, during stopping of the internal combustion engine, a back-up RAM stores the actual valve timing that is computed based on the output signal outputted by the cam angle sensor immediately before the stop of the engine. Note that the back-up RAM is a memory capable of keeping the stored data by the assist of a vehicle battery as a power source for backing up the data even while the internal combustion engine is stopped. Then, during the starting of the internal combustion engine in a next operation, until a time at which the cam angle sensor starts outputting the cam angle signal, a valve timing change amount is computed based on a rotational speed of a motor of the variable valve timing apparatus, and the valve timing change amount is integrated to the value of the actual valve timing stored immediately before the stopping of the engine in the previous operation in order to obtain the actual valve timing.

However, even when the actual valve timing is once stored in the back-up RAM during stopping of the internal combustion engine, the stored data once stored in the back-up RAM may have been cleared due to the cut-off of the power source for backing up the data caused by detachment of the vehicle battery while the internal combustion engine is at rest. In the above case, when the internal combustion engine is to be started in the next operation, it is impossible to compute the actual valve timing disadvantageously until the cam angle sensor starts outputting the cam angle signals.

As the countermeasure for the above disadvantages, for example, a technique described in JP-A-2001-82190 may be employed. More specifically, during the starting of the internal combustion engine, the valve timing is forcibly changed to the limit position within the mechanically-movable range of the variable valve timing apparatus such that the valve timing is forcibly controlled to the reference position. Thus, detection of the present actual valve timing (reference position) is enabled before the cam angle sensor starts outputting the cam angle signals, and thereby the computation of the actual valve timing is started earlier.

However, recently, the movable range of valve timing is likely to be made larger in order to improve the fuel efficiency, and thereby the actual valve timing may be disadvantageously moved to certain valve timing that is beyond a range that enables the starting of the internal combustion engine. Thereby, if the actual valve timing is forcibly changed to the reference position at the start of the internal combustion engine, the startability of the engine may deteriorate disadvantageously.

SUMMARY OF THE INVENTION

The present invention is made in view of the above disadvantages. Thus, it is an objective of the present invention to address at least one of the above disadvantages.

To achieve the objective of the present invention, there is also provided A control device for a variable valve timing apparatus that changes valve timing of at least one of an intake valve and an exhaust valve of an internal combustion engine, the control device including an actual valve timing computing unit and a valve timing controlling unit. The actual valve timing computing unit computes actual valve timing. The valve timing controlling unit controls the variable valve timing apparatus to maintain present valve timing during starting of the internal combustion engine before the actual valve timing computing unit becomes capable of computing the actual valve timing. The valve timing controlling unit controls the variable valve timing apparatus such that the actual valve timing becomes target valve timing during the starting of the internal combustion engine after the actual valve timing computing unit becomes capable of computing the actual valve timing.

To achieve the objective of the present invention, there is also provided a control device for controlling a variable valve timing apparatus that changes valve timing of at least one of an intake valve and an exhaust valve of an internal combustion engine, the control device including a sensor, a memory, a valve timing computing unit, and a valve timing controlling unit. The sensor outputs an output signal associated with actual valve timing. The memory is configured to store a first information item associated with the actual valve timing obtained during stopping of the engine and a second information item associated with reference timing of the valve timing. The valve timing computing unit is configured to compute the valve timing based on the first information item stored in the memory during a first period that ranges from a time, at which the engine is started, to another time, at which the sensor starts outputting the output signal. The valve timing computing unit is configured to compute the valve timing based on the second information item stored in the memory and the output signal during a second period, in which the sensor outputs the output signal. The valve timing controlling unit is configured to control the variable valve timing apparatus such that the valve timing computed by the valve timing computing unit becomes target valve timing. In a case, where the first information item is not stored in the memory during the first period, the valve timing controlling unit controls the variable valve timing apparatus such that present valve timing is maintained.

To achieve the objective of the present invention, there is also provided a control device for controlling a variable valve timing apparatus that changes valve timing of at least one of an intake valve and an exhaust valve of an internal combustion engine, the control device including a valve timing computing unit and a valve timing controlling unit. The valve timing computing unit is configured to compute the valve timing based on a first information item stored in an external memory during a first period that ranges from a time, at which the engine is started, to another time, at which an external sensor starts outputting an output signal that is associated with actual valve timing. The first information is associated with actual valve timing obtained during stopping of the engine. The valve timing computing unit is configured to compute the valve timing based on a second information item stored in the memory and the output signal outputted by the sensor during a second period, in which the sensor outputs the output signal. The second information item is associated with reference timing of the valve timing. The valve timing controlling unit is configured to control the variable valve timing apparatus such that the valve timing computed by the valve timing computing unit becomes target valve timing. In a case, where the first information item is not stored in the memory during the first period, the valve timing controlling unit controls the variable valve timing apparatus such that present valve timing is maintained.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

One embodiment of the present invention wilt be described below.

Figure 1:
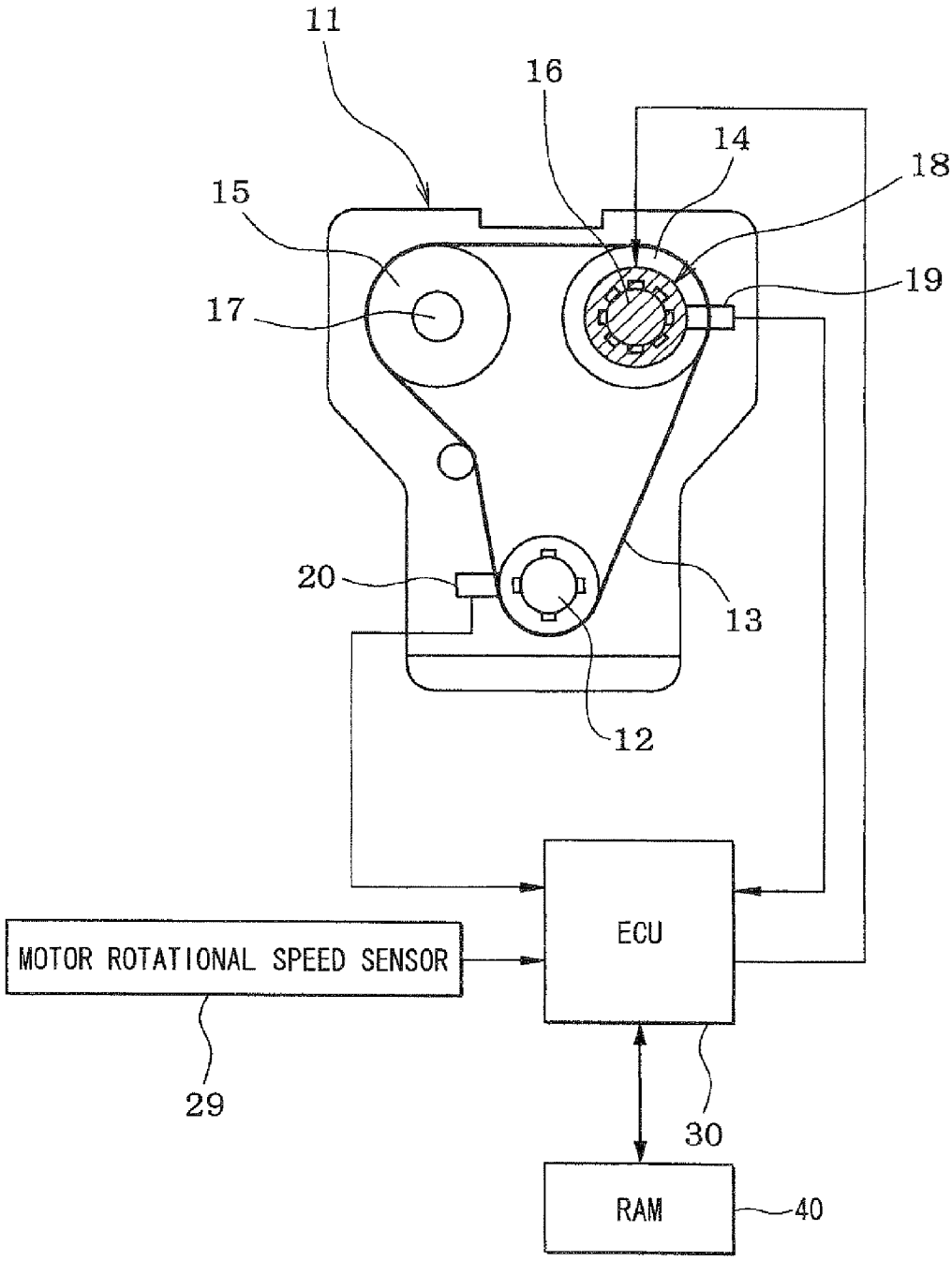
FIG. 1 is a general schematic configuration of a valve timing control system according to one embodiment of the present invention.

A general schematic configuration of a system will be described with reference to FIG. 1.

An engine 11 includes a crankshaft 12, a timing chain 13, sprockets 14, 15, an intake-side camshaft 16, and an exhaust-side camshaft 17. The engine 11 is an internal combustion engine, and motive power from the crankshaft 12 is transmitted to the intake-side camshaft 16 and the exhaust-side camshaft 17 through each of the sprockets 14, 15 and the timing chain 13 (or a timing belt). Also, a motor-actuated variable valve timing apparatus 18 is provided on a side of the intake-side camshaft 16 of the engine 11. The variable valve timing apparatus 18 changes a rotational phase (camshaft phase) of the intake-side camshaft 16 with respect to the crankshaft 12 in order to change the valve timing of an intake valve (not shown) that is opened and closed by the intake-side camshaft 16.

Also, The system includes a cam angle sensor 19 at a radially outer side of the intake-side camshaft 16, and the cam angle sensor 19 outputs a cam angle signal in response to every predetermined cam angle of the intake-side camshaft 16 synchronously with the rotation of the intake-side camshaft 16. Also, the system includes a crank angle sensor 20 at a radially outer side of the crankshaft 12, and the crank angle sensor 20 outputs a crank angle signal in response to every predetermined crank angle synchronously with the rotation of the crankshaft 12.

Figure 2:
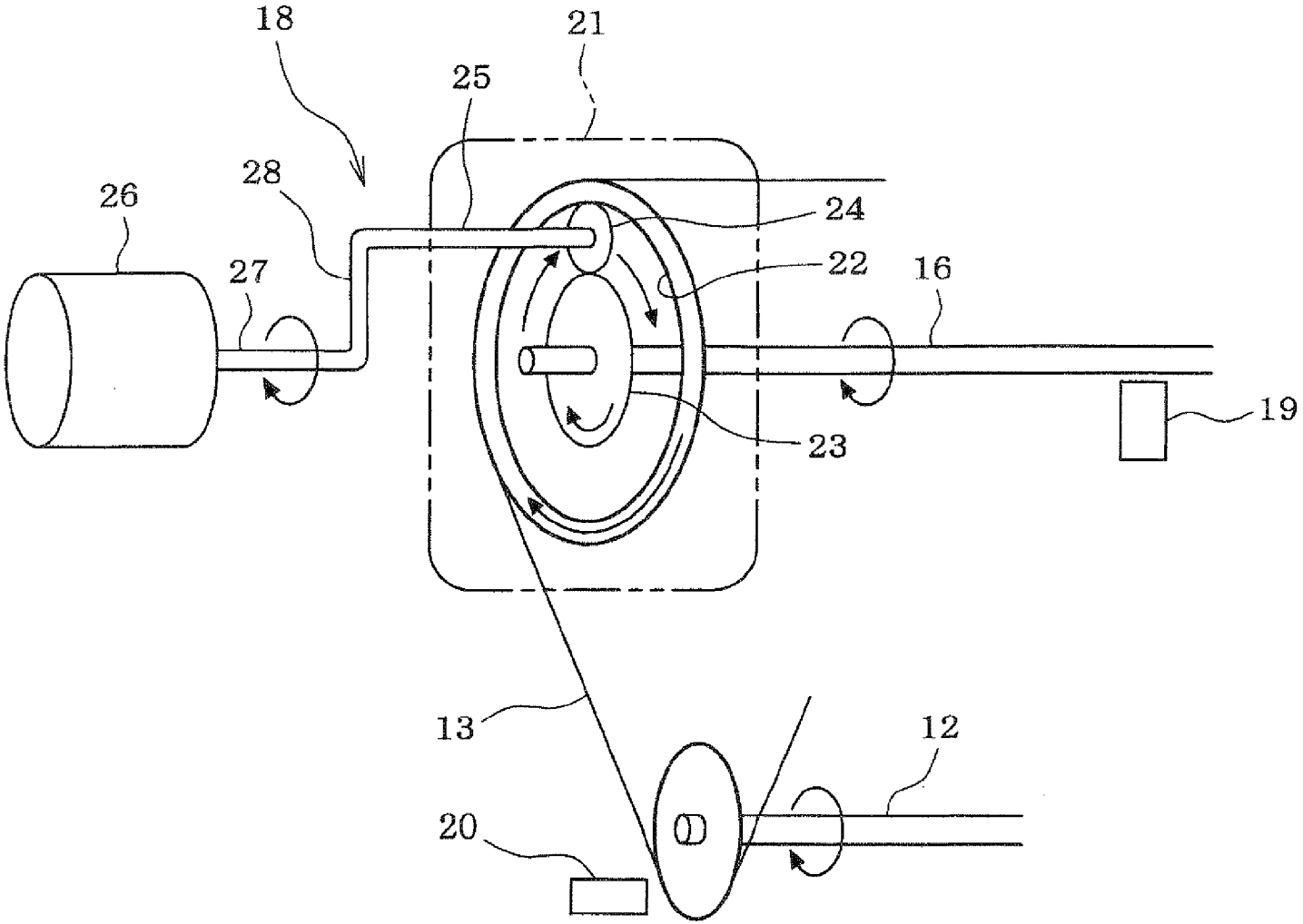
FIG. 2 is a schematic configuration illustrating a variable valve timing apparatus.

A schematic configuration of the variable valve timing apparatus 18 will be described with reference to FIG. 2. The variable valve timing apparatus 18 includes a phase shifting mechanism 21 that has an outer ring gear 22, an inner central gear 23 and a planetary gear 24. The outer ring gear 22 is provided coaxially with the intake-side camshaft 16 and has inward-facing tooth projecting from the outer ring. The inner central gear 23 is coaxially provided on a radially inward side of the outer ring gear 22 and has outward-facing tooth. The planetary gear 24 is provided radially between the outer ring gear 22 and the inner central gear 23 and is in mesh with the outer ring gear 22 and the inner central gear 23. The outer ring gear 22 is configured to rotate integrally with the sprocket 14 that rotates synchronously with the crankshaft 12. The inner central gear 23 is configured to rotate integrally with the intake-side camshaft 16. Also, the planetary gear 24 revolves about the inner central gear 23 in a circular orbit in mesh with the outer ring gear 22 and the inner central gear 23. Thus, a turning force of the outer ring gear 22 is transmitted to the inner central gear 23. At the same time, by changing the revolution speed of the planetary gear 24 about the inner central gear 23 relative to a rotational speed of the inner central gear 23 (or, the rotational speed of the intake-side camshaft 16), the rotational phase of the inner central gear 23 with respect to the outer ring gear 22 (camshaft phase) is adjustable.

The engine 11 includes a motor 26 that changes the revolution speed of the planetary gear 24. The motor 26 has a rotating shaft 27 provided coaxially with the intake-side camshaft 16, the outer ring gear 22, and the inner central gear 23. A connection member 28 that extends in a radial direction of the motor 26 connects the rotating shaft 27 of the motor 26 with a supporting shaft 25 of the planetary gear 24. Thus, the planetary gear 24 rotates about the supporting shaft 25 (or about its own axis) and rotates around the inner central gear 23 or rotates in the circular orbit at a radially outer side of the inner central gear 23 based on the rotation of the motor 26. Also, the motor 26 is attached with a motor rotational speed sensor 29 that detects a rotational speed RM of the motor 26 as shown in FIG. 1. More specifically, the motor rotational speed sensor 29 detects a rotational speed of the rotating shaft 27.

The outer ring gear 22, the inner central gear 23, and the planetary gear 24 of the variable valve timing apparatus 18 are configured such that the intake-side camshaft 16 turns at ½ of the rotational speed of the crankshaft 12 at a regular operation. Thus, at the regular operation, half the rotational speed of the crankshaft 12 is equal to the rotational speed of the intake-side camshaft 16. Also, the outer ring gear 22, the inner central gear 23, and the planetary gear 24 are configured to change valve timing of the intake valve or the camshaft phase by adjusting the rotational speed RM (rpm) of the motor 26 relative to ½ of the rotational speed of the crankshaft 12.

When the change of the valve timing is limited, the rotational speed RM of the motor 26 is caused to match with the rotational speed of the outer ring gear 22 or with ½ of the rotational speed of the crankshaft 12 such that the revolution speed of the planetary gear 24 becomes the rotational speed of the outer ring gear 22. As a result, a present difference of rotational phases between the outer ring gear 22 and the inner central gear 23 is kept the same such that the valve timing or the camshaft phase is kept the same.

Then, when the valve timing is to be changed, the rotational speed RM of the motor 26 is changed relative to the rotational speed of the outer ring gear 22 such that the revolution speed of the planetary gear 24 is changed relative to the rotational speed of the outer ring gear 22. As a result, the difference of the rotational phases between the outer ring gear 22 and the inner central gear 23 is changed, and thereby the valve timing or the camshaft phase is changed.

For example, when the valve timing is to be advanced, the rotational speed RM of the motor 26 is made higher than the rotational speed of the outer ring gear 22 such that the revolution speed of the planetary gear 24 becomes higher than the rotational speed of the outer ring gear 22. As a result, the rotational phase of the inner central gear 23 with respect to the outer ring gear 22 is advanced, and thereby the valve timing or the camshaft phase is advanced.

In contrast, when the valve timing is to be retarded, the rotational speed RM of the motor 26 is made lower than the rotational speed of the outer ring gear 22 such that the revolution speed of the planetary gear 24 becomes lower than the rotational speed of the outer ring gear 22. As a result, the rotational phase of the inner central gear 23 with respect to the outer ring gear 22 is retarded, and thereby the valve timing or the camshaft phase is retarded.

Outputs from the above various sensors are inputted into an engine control circuit (ECU) 30. The ECU 30 is mainly made of a microcomputer and executes various engine control programs stored in a ROM (storage medium) such that the ECU 30 controls a fuel injection quantity of fuel injection valve (not shown) and ignition timing of ignition plug (not shown) in accordance with engine operational states.

Figure 5:
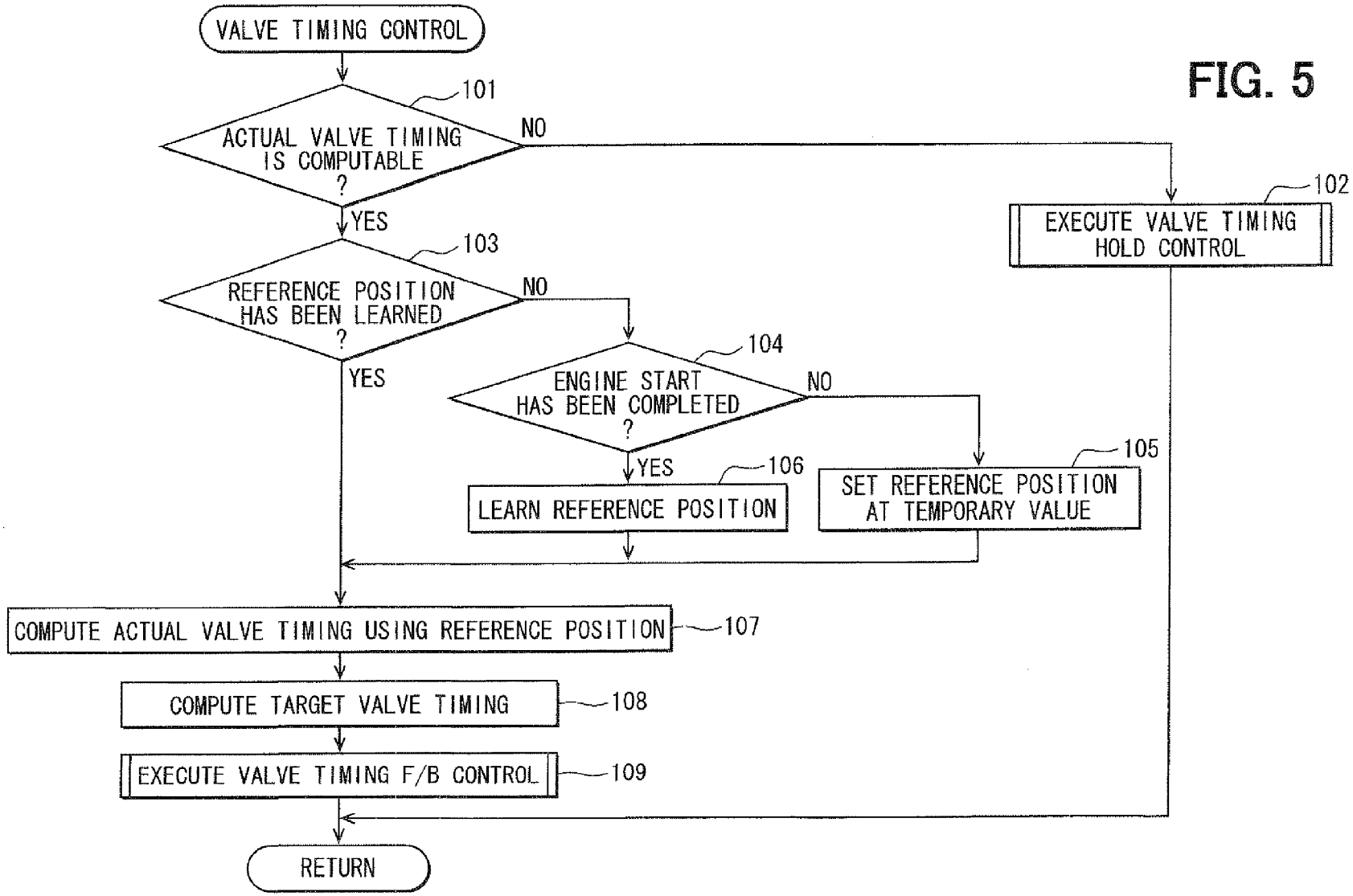
FIG. 5 is a flow chart illustrating a process of a valve timing control main routine.
Figure 6:
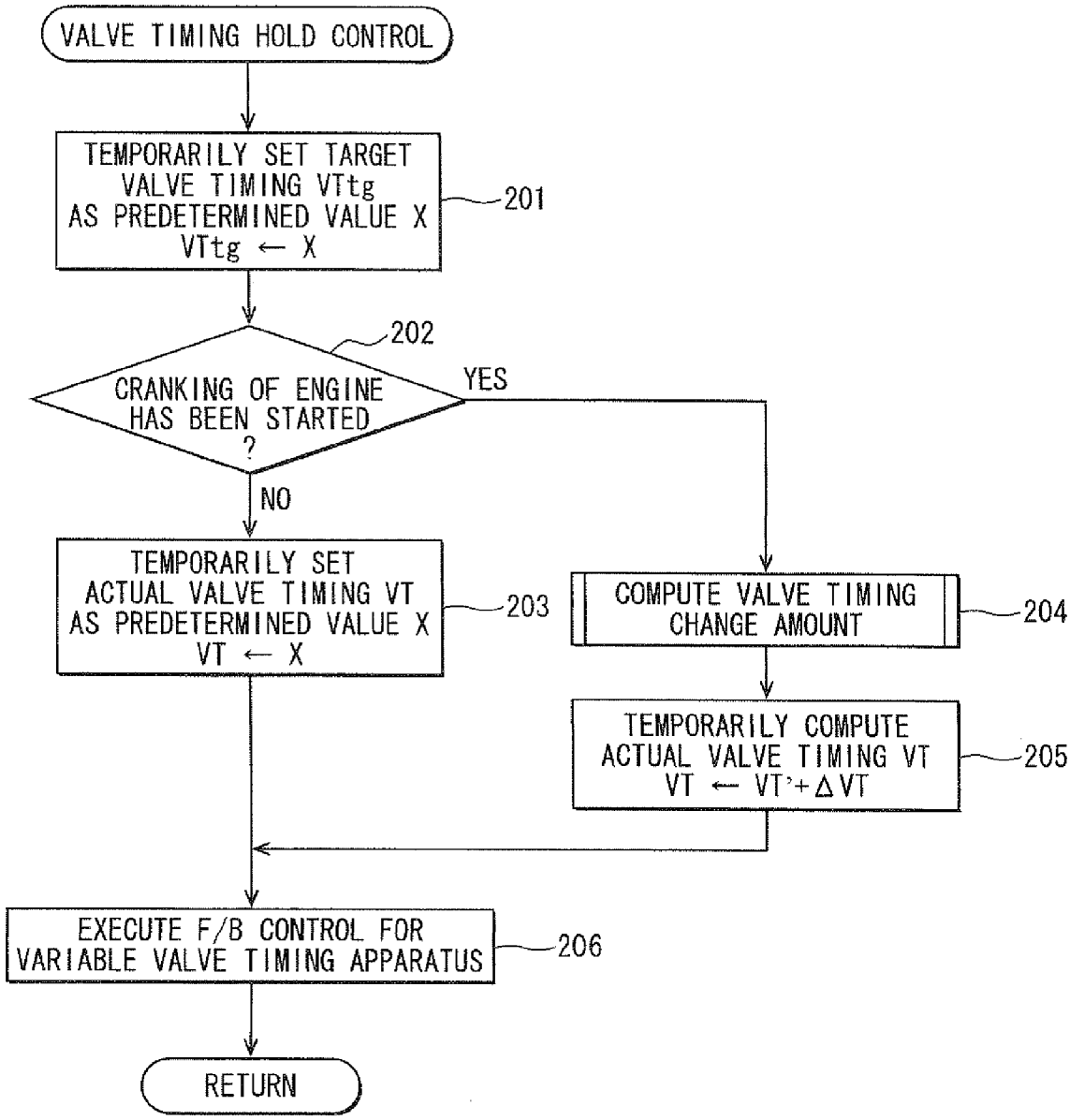
FIG. 6 is a flow chart illustrating a process of a valve timing hold control routine.
Figure 7:
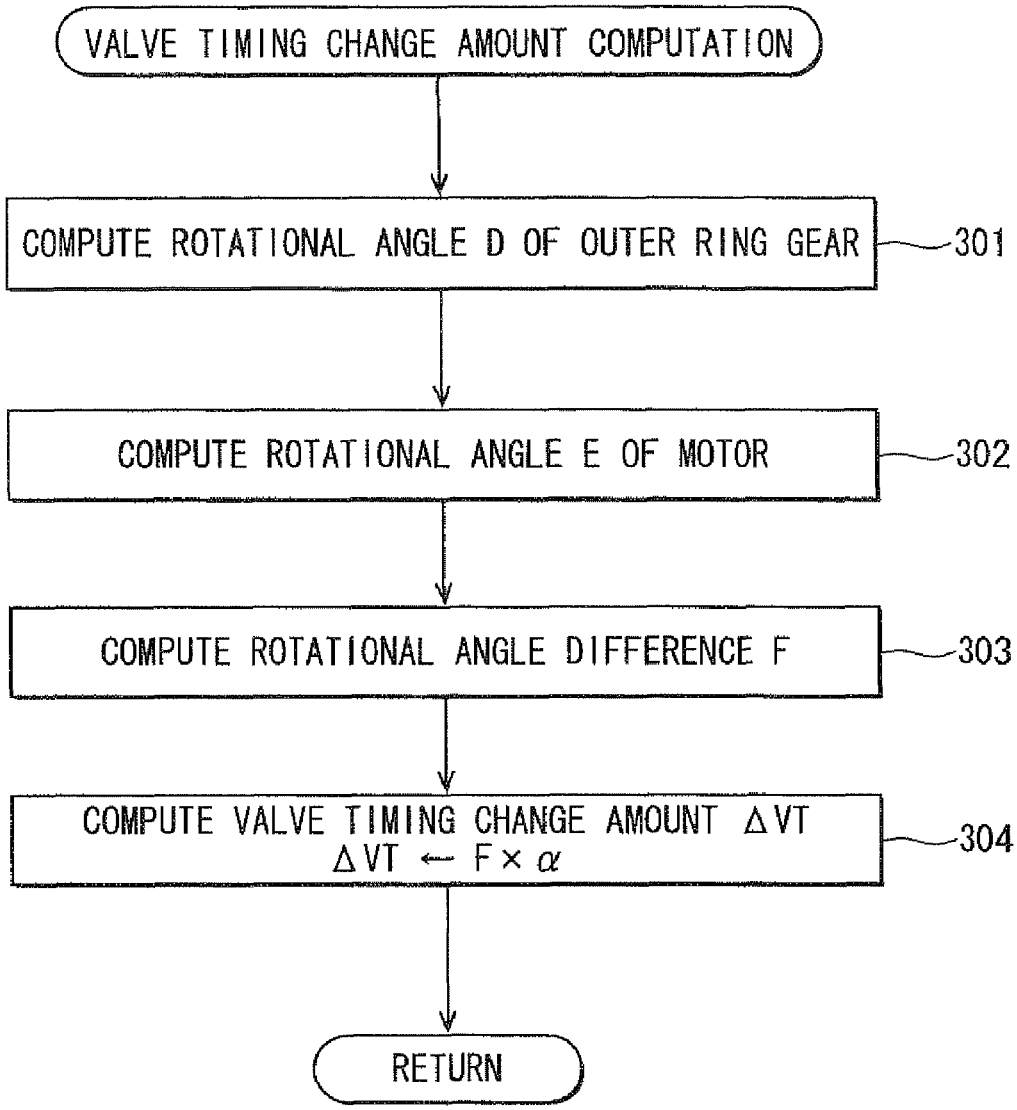
FIG. 7 is a flow chart illustrating a process of a valve timing change amount computation routine.

Also, the ECU 30 operates valve timing controls by executing the routines for the valve timing controls shown in FIG. 5 to FIG. 7.

The ECU 30 is connected with a back-up RAM 40 and stores in the back-up RAM 40 (a) actual valve timing during stopping of the engine and (b) a reference value for a reference position of valve timing. In other words, the back-up RAM 40 stores (a) (a) a first information item associated with the actual valve timing obtained during stopping of the engine and (b) a second information item associated with reference timing of the valve timing. The back-up RAM 40 serves as a memory that keeps stored data with an aid of a vehicle battery as a power source for backing up the data even while the engine stops. For example, the reference value for the reference position corresponds to a full retard position of the camshaft phase and corresponds to reference timing.

Figure 3:
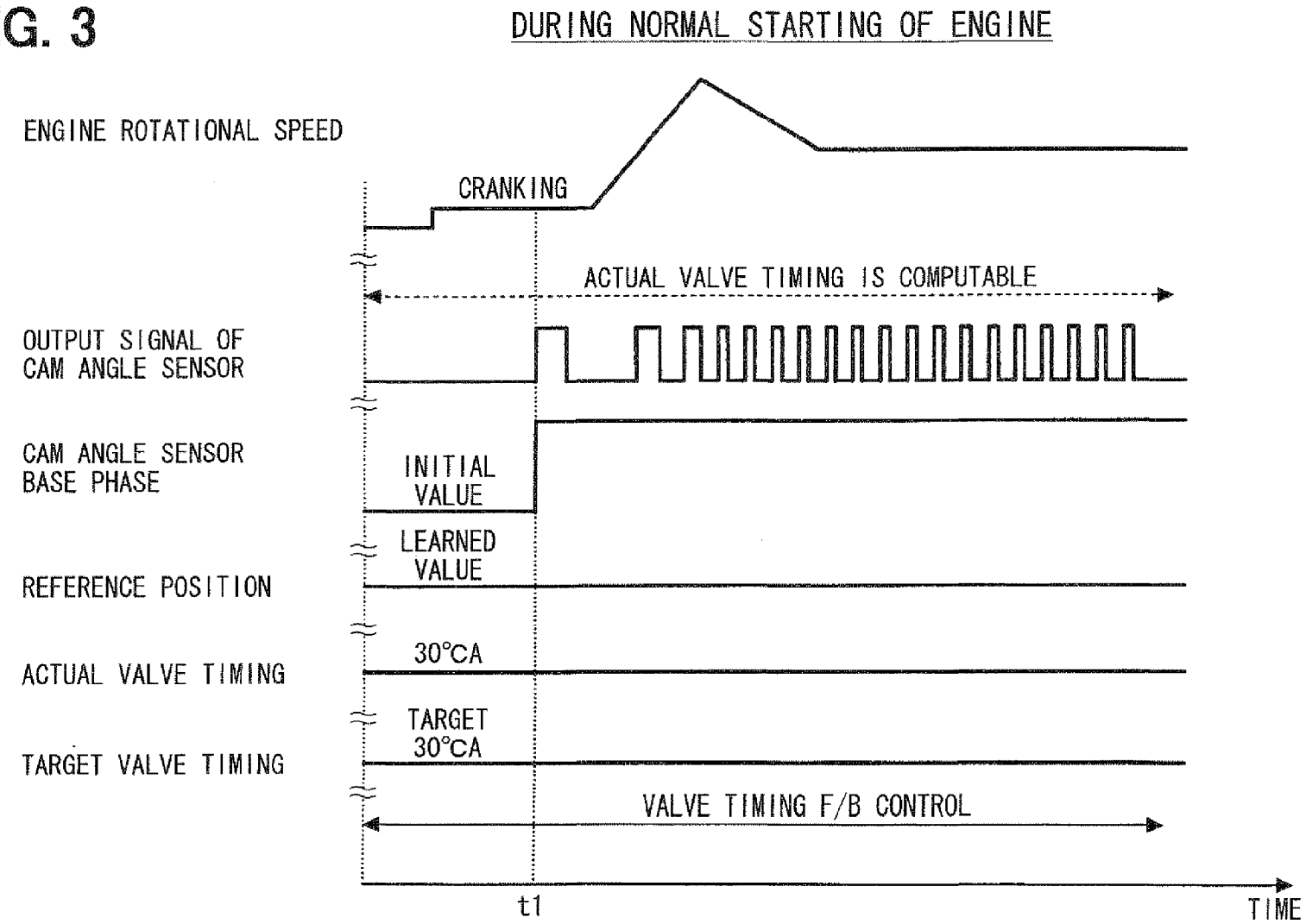
FIG. 3 is a timing chart illustrating a valve timing control under a normal operation during starting of an engine.

FIG. 3 shows a timing chart at a normal operation during starting of the engine. At the normal starting operation, the back-up RAM 40 of the ECU 30 keeps the stored data. As shown in the timing chart of FIG. 3, in the normal operation during the stating of the engine, the crank angle sensor 20 starts outputting the crank angle signal after starting the cranking of the engine, and then the cam angle sensor 19 starts outputting the cam angle signal at time point t1. Thus, computation of the actual valve timing based on the output signals of the crank angle sensor 20 and the cam angle sensor 19 is made possible after the time point t1. As a result, until the time point t1, the computation of the actual valve timing by a different method is required. More specifically, a valve timing change amount is computed based on a difference between the rotation angle of the motor 26 and the rotation angle of the outer ring gear 22 of the variable valve timing apparatus 18. In other words, the valve timing change amount is computed based on the difference between the rotation angle of the motor 26 and ½ of the rotation angle of the crankshaft 12. Then, the valve timing change amount is integrated to information (a value), which is associated with the actual valve timing, and which is stored during the stopping of the engine in the previous operation, in order to compute the actual valve timing (estimation value of the valve timing) in the present operation. Thus, the valve timing is computed based on the first information item stored in the back-up RAM 40 during a first period that ranges from a time, at which the engine is started, to another time, at which the cam angle sensor 19 starts outputting the output signal. Also, the valve timing is computed based on the second information item stored in the back-up RAM 40 and the output signal during a second period, in which the cam angle sensor 19 outputs the output signal. For example, the first period corresponds to a time period from a left end of the horizontal axis to time t1 in FIGS. 3 and 4, and the second period corresponds to another time period, which starts from time t1, and which follows the first period in FIGS. 3 and 4.

Then, after the time point t1, at which the cam angle sensor 19 starts outputting the cam angle signal, a cam angle sensor base phase is computed based on the crank angle signal outputted from the crank angle sensor 20 and the cam angle signal outputted from the cam angle sensor 19. Then, the actual valve timing is computed by using the cam angle sensor base phase and the reference position (reference timing). In the above computation, the cam angle sensor base phase is a rotational phase of the cam angle signal with respect to the crank angle signal, and the reference position is learned based on the reference value stored in the back-up RAM 40, for example. The computed actual valve timing is actual valve timing on a basis of the reference position and corresponds to an advance amount from the reference position (full retard position).

$$\text{actual valve timing} = \text{cam angle sensor base phase} - \text{reference position}$$

In the above computation, it is possible to compute the actual valve timing immediately after the power source of the ECU becomes on (for example, the ignition switch becomes on). Thus, a valve timing F/B control for feedback-controlling the motor 26 of the variable valve timing apparatus 18 is executed such that the actual valve timing becomes target valve timing immediately after the power source of the ECU 30 becomes on.

Figure 4:
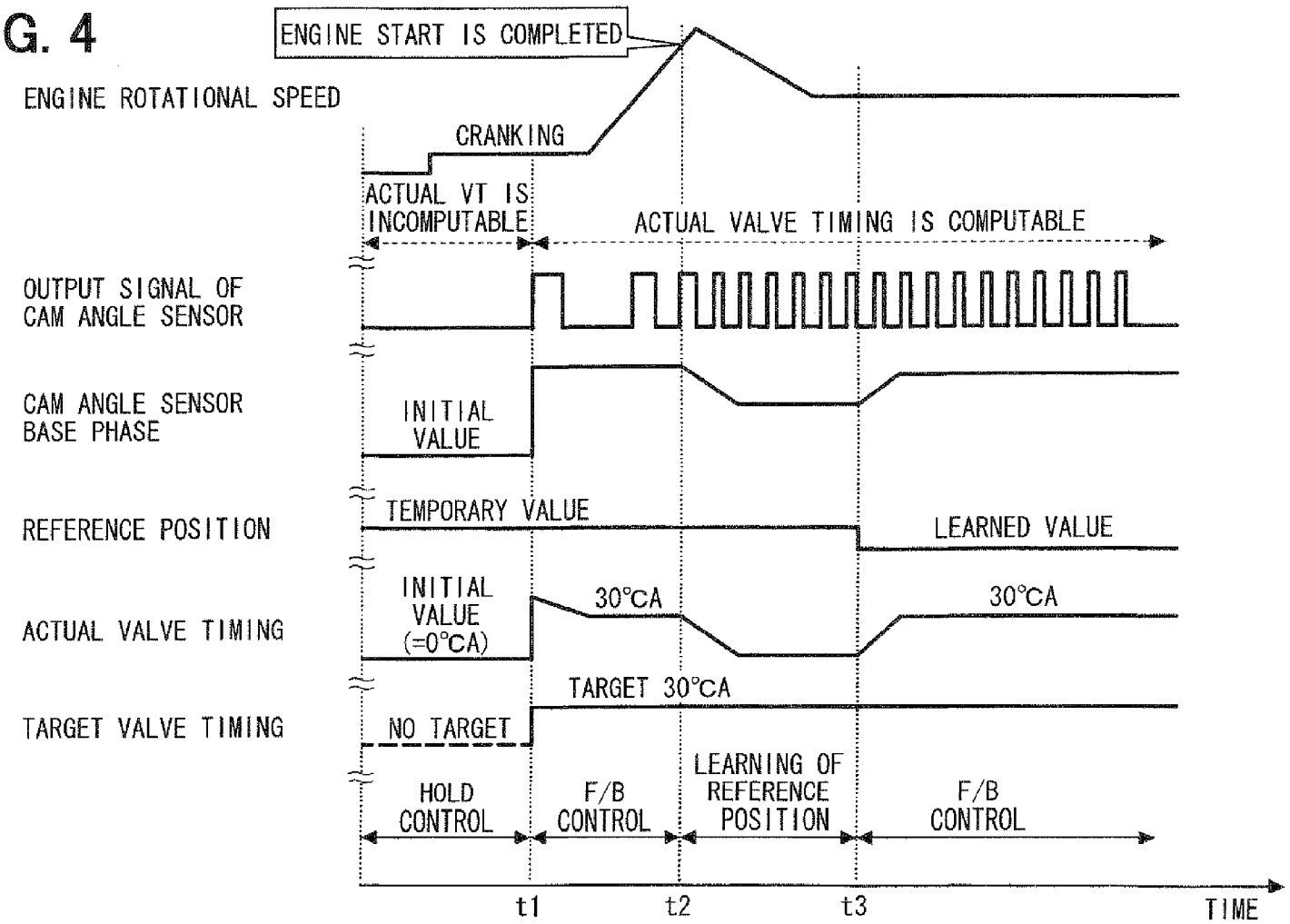
FIG. 4 is a timing chart illustrating another valve timing control under a different operation during starting of the engine for a case, where a stored data of a battery has been erroneously cleared due to battery failure.

In contrast, FIG. 4 is another timing chart for a case, where the stored data in the back-up RAM 40 of the ECU 30 has been cleared due to the cut-off of the power source for the RAM 40 caused by, for example, detachment of the vehicle battery. The above case is referred as a battery-clear case. As shown in the timing chart of FIG. 4, in the battery-clear case while the engine stops, after turning on the power source of the ECU 30, a value for the actual valve timing is set at an initial value (for example, 0° CA), and the reference position is set at a temporary value for the reference position or a temporary reference position (for example, a design target value for the reference position). The design target value for the reference position is a theoretical value for the reference position without considering the manufacturing variations, for example.

In the above case, during the starting of the engine 11, it is impossible to compute the actual valve timing until the time point t1, at which the cam angle sensor 19 starts outputting the cam angle signal after starting the cranking of the engine. Until the time point t1, the ECU 30 executes a valve timing hold control for controlling the variable valve timing apparatus 18 in order to keep the valve timing at a present value (or in order to maintain the present valve timing).

After the time point t1, at which the cam angle sensor 19 starts outputting the cam angle signals, the cam angle sensor base phase is computed based on the crank angle signal outputted from the crank angle sensor 20 and the cam angle signal outputted from the cam angle sensor 19. Then, the actual valve timing is computed based on the computed cam angle sensor base phase and the temporary reference position. More specifically, the above computed actual valve timing is valve timing on a basis of the temporary reference position and corresponds to the advance amount from the temporary reference position.

actual valve timing=cam angle sensor base phase−temporary reference position

Then, the ECU 30 executes the valve timing F/B control for controlling the variable valve timing apparatus 18 by the F/B control such that the actual valve timing becomes the target valve timing.

Then, at time point t2, at which the starting of the engine 11 is completed, the learning of the reference position is started. Specifically, in the learning process, the valve timing or the camshaft phase is forcibly changed to a limit position (for example, a full retard position) within a mechanically-movable range of the variable valve timing apparatus 18, and the ECU 30 stores in the back-up RAM 40 the cam angle sensor base phase under the above forcibly changed situation as a learned value for the reference position of the valve timing. As above, the learning of the reference position is executed. In other words, the ECU 30 computes the second information item as above and causes the back-up RAM 40 to store the computed second information item therein. More specifically, the ECU 30 computes the second information item after starting of the engine has been completed during the second period.

After time point t3, at which the learning of the reference position is completed, the cam angle sensor base phase is computed based on the crank angle signal outputted from the crank angle sensor 20 and the cam angle signal outputted from the cam angle sensor 19. Thus, the actual valve timing is computed by using the cam angle sensor base phase and the learned value of the reference position. Thus, the computed actual valve timing is valve timing on the basis of the reference position and corresponds to the advance amount from the reference position.

actual valve timing=cam angle sensor base phase−reference position

The ECU 30 executes the valve timing F/B control for feedback-controlling the motor 26 of the variable valve timing apparatus 18 in order to cause the actual valve timing to become the target valve timing.

Then, after the stopping of the engine 11, the actual valve timing based on the output signal of the cam angle sensor 19 computed immediately before the stopping of the engine 11 is stored in the back-up RAM 40 of the ECU 30.

In the above valve timing control, the ECU 30 executes each valve timing control routine shown in FIG. 5 to FIG. 7. Processes in each of the routines will be described below.

[Valve Timing Control Main Routine]

The valve timing control main routine shown in FIG. 5 serves as a valve timing controlling unit, and is periodically executed at predetermined intervals while the power source of the ECU 30 is on. When the present routine is started, it is determined at step 101 based on the following conditions (1) to (3) whether it is possible to compute the actual valve timing, for example.

(1) The computation of the actual valve timing has been started.

(2) The back-up RAM 40 keeps the stored data of the actual valve timing stored during stopping of the engine 11. In other words, the stored data once stored in the back-up RAM 40 has not been cleared due to the cut-off of the power from the battery, for example.

(3) The cam angle sensor 19 has started outputting the cam angle signal.

It is determined that it is possible to compute the actual valve timing when at least one of the above conditions (1) to (3) is satisfied. In other words, when none one of the conditions (1) to (3) is satisfied, it is determined that it is impossible to compute the actual valve timing.

When it is determined at step 101 that it is impossible to compute the actual valve timing, control proceeds to step 102, where the valve timing hold control for controlling the variable valve timing apparatus 18 is executed such that the valve timing is kept at the present value. More specifically, at step 102, the valve timing hold control routine shown in FIG. 6 and explained below will be executed for executing the valve timing hold control.

In contrast, it is determined at step 101 that it is possible to compute the actual valve timing, control proceeds to step 103, where it is determined whether the reference position has been already learned. In other words, it is determined at step 103 whether the back-up RAM 40 keeps data of the learned value for the reference position.

When it is determined at step 103 that the reference position has not been learned, control proceeds to step 104, where it is determined whether the starting of the engine 11 has been completed. For example, the completion of the starting of the engine 11 may be determined by whether the rotation speed of the engine 11 exceeds a predetermined complete combustion determination value or not.

When it is determined at step 104 that the starting of the engine 11 has not been completed, control proceeds to step 105, where the reference position is set as the temporary value of the reference position or is kept at the temporary value. Then, control proceeds to step 107, where the cam angle sensor base phase is computed based on the crank angle signal outputted from the crank angle sensor 20 and the cam angle signal outputted from the cam angle sensor 19. Thus, the actual valve timing on the basis of the temporary reference position is computed by using the computed cam angle sensor base phase and the reference position (the temporary value of the reference position).

actual valve timing=cam angle sensor base phase−temporary reference position

Then, when it is determined at step 104 that the starting of the engine 11 has been completed, control proceeds to step 106, where the valve timing or the camshaft phase is forcibly changed to the limit position within the mechanically-movable range of the variable valve timing apparatus 18, and the valve timing or the cam angle sensor base phase at the above forcible phase changed condition is stored in the back-up RAM 40 of the ECU 30 as the learned value of the reference position. As above, the reference position is learned. The process in step 106 serves as a reference timing computing unit.

After learning the reference position at step 106, or when it is determined at step 103 that the reference position has already been learned, control proceeds to step 107, where the cam angle sensor base phase is computed based on the crank angle signal and the cam angle signal. The actual valve timing on the basis of the reference position is computed by using the cam angle sensor base phase and the reference position (the learned value of the reference position).

actual valve timing=cam angle sensor base phase−reference position

The process at step 107 serves as an actual valve timing computing unit.

It should be noted that before the cam angle sensor 19 start outputting the cam angle signals, the valve timing change amount is computed based on the difference between the rotation angle of the motor 26 and the rotation angle of the outer ring gear 22 of the variable valve timing apparatus 18. Then, the actual valve timing of the present operation is computed by integrating the computed valve timing change amount to the actual valve timing stored during the stopping of the engine 11 in the previous operation.

Then, control proceeds to step 108, where the target valve timing is computed based on an engine operational state (for example, engine rotation speed, load), and then control proceeds to step 109, where the valve timing F/B control for feedback-controlling the variable valve timing apparatus 18 is executed such that the actual valve timing becomes the target valve timing. In other words, the valve timing F/B control is executed such that the valve timing is adjusted to a target value based on the estimation value of the valve timing.

[The Valve Timing Hold Control Routine ]

The valve timing hold control routine shown in FIG. 6 is a subroutine executed in step 102 of the valve timing control main routine shown in FIG. 5. When the present routine is started, firstly, target valve timing VTtg is set at a predetermined value X at step 201.

VTtg=X

Then, control proceeds to step 202, where it is determined whether the cranking of the engine 11 has been started. When it is determined that the cranking of the engine 11 has not been started or that the rotation of the engine 11 has been stopped, control proceeds to step 203, where the actual valve timing VT is set as the predetermined value X. In other words, the value of the actual valve timing VT is set equal to the target valve timing VTtg.

VT=X

Then, control proceeds to step 206, where the valve timing hold control for controlling the motor 26 of the variable valve timing apparatus 18 is executed such that the valve timing is kept at the present value. More specifically, in the valve timing hold control, the motor 26 of the variable valve timing apparatus 18 is feedback-controlled such that the actual valve timing VT, which has been temporarily set as X, becomes the target valve timing VTtg, which has been also set as X.

In contrast when it is determined at step 202 that the cranking of the engine has been started or that the engine 11 is rotating, control proceeds to step 204, where a valve timing change amount computation routine shown in FIG. 7 and described below is executed such that a valve timing change amount ΔVT over the computation interval is computed.

Then, control proceeds to step 205, where the above computed valve timing change amount ΔVT is added to the actual valve timing VT' of the previous operation such that the actual valve timing VT of the present operation is temporarily computed.

Then, control proceeds to step 206, where the valve timing hold control for controlling the variable valve timing apparatus 18 in order to keep the valve timing at the present value is executed. More specifically, the motor 26 of the variable valve timing apparatus 18 is feedback-controlled such that the temporarily computed actual valve timing VT corresponds to the target valve timing VTtg (X). As a result, the valve timing is held at the present value.

[Valve Timing Change Amount Computation Routine]

The valve timing change amount computation routine shown in FIG. 7 is a subroutine executed at step 204 of the valve timing hold control routine shown in FIG. 6. When the present routine is started, firstly, a rotation angle D of the outer ring gear 22 over the computation interval is computed at step 301. In other words, at step 301, ½ of the rotation angle of the crankshaft 12 over the computation interval is computed. Then, control proceeds to step 302, where a rotation angle E of the motor 26 of the variable valve timing apparatus 18 over the computation interval is computed.

Then, control proceeds to step 303, where a difference F between the rotation angle E of the motor 26 and the rotation angle D of the outer ring gear 22 is computed. Then, control proceeds to step 304, where the rotation angle difference F is multiplied by a coefficient α in order to obtain the valve timing change amount ΔVT over the computation interval.

$$\Delta VT = F \times \alpha$$

In the present embodiment, information items associated with the reference position of the valve timing and with the actual valve timing stored during the stopping of the engine 11 are stored in the back-up RAM 40 of the ECU 30. When the engine 11 is started normally, until the cam angle sensor 19 starts outputting the cam angle signals, the actual valve timing is computed by integrating the valve timing change amount to the actual valve timing stored during the stopping of the engine 11 in the previous operation.

Then, after the cam angle sensor 19 starts outputting the cam angle signals, the cam angle sensor base phase is computed based on the crank angle signal and the cam angle signal. Thus, the actual valve timing on the basis of the reference position is computed by using the cam angle sensor base phase and the reference position (the learned reference value). As a result, the computation error for computing the actual valve timing caused by manufacturing variations or aged deterioration of the variable valve timing apparatus 18 is effectively corrected.

In contrast, in a case, where the stored data of the actual valve timing once stored during stopping of the engine 11 has been erroneously cleared due to the cut-off of the power from the battery, the actual valve timing is not computed during the starting of the engine 11 until the cam angle sensor 19 starts outputting the cam angle signals. However, during the above period, the valve timing hold control is executed for controlling the motor 26 of the variable valve timing apparatus 18 in order to keep the valve timing at the present value.

In general, a system having the variable valve timing apparatus 18 is configured in a manner, where the valve timing is controlled immediately before the stopping of the engine 11 such that the valve timing is caused to correspond to a value that is suitable for the starting of the engine 11 in order to secure the startability of the engine 11 in the next operation. During the certain period, in which it is impossible to compute the actual valve timing at the starting of the engine 11, the valve timing hold control for holding the actual valve timing is executed as described in the present embodiment. As a result, the actual valve timing is caused to stay within a certain range, in which it is possible to start the engine 11, and thereby the startability of the engine 11 is effectively secured.

Also, in the present embodiment, the actual valve timing is computed on the basis of the temporary reference position before the reference position is learned. Even when the stored data of the learned value for the reference position has been cleared at the starting of the engine 11 due to the erroneous cut-off of the power from the battery, it is possible to compute the actual valve timing on the basis of the temporary value of the reference position even before the reference position is learned.

Furthermore, in general, the manufacturing variations or the aged deterioration of the variable valve timing apparatus 18 does not widely deviate an actual value of the reference position from the design target value thereof. Thus, accuracy in the computation of the actual valve timing is substantially secured even when the actual valve timing (estimation value of the valve timing) is computed on the basis of the temporary reference position before the value of the reference position is learned, because the temporary reference position is set at the design target value for the reference position.

Also, in the present embodiment, the value for the reference position is to be learned after the starting of the engine 11 is completed. In other words, the learning of the value for the reference position is limited during the starting of the engine 11. As a result, the learning of the value of the reference position during the starting of the engine 11 does not cause the actual valve timing to deviate from a certain starting range of valve timing that enables the starting of the engine 11, and thereby deterioration of the startability of the engine 11 is effectively limited.

It should be noted that in the above embodiment, the actual valve timing is computed based on the crank angle signal outputted from the crank angle sensor 20 and the cam angle signal outputted from the cam angle sensor 19. However, the present invention is not limited to the above. In a case, where a system includes a sensor that detects information of the actual valve timing, an output signal from the sensor may be employed to compute the actual valve timing, alternatively.

Also, the applicable range of the present invention is not limited to the system having the variable valve timing apparatus for changing the valve timing of the intake valve. The present invention is applicable to a system having a variable valve timing apparatus for changing valve timing of an exhaust valve.

Furthermore, the applicable range of the present invention is not limited to the system having the motor-actuated variable valve timing apparatus. The present invention is also applicable to a system having an oil-actuated variable valve timing apparatus.

Additional advantages and modifications will readily occur to those skilled in the art. The invention in its broader terms is therefore not limited to the specific details, representative apparatus, and illustrative examples shown and described.

What is claimed is:

1. A control device for a variable valve timing apparatus that changes valve timing of at least one of an intake valve and an exhaust valve of an internal combustion engine, the control device comprising:

an actual valve timing computing unit that computes actual valve timing; and a valve timing controlling unit that controls the variable valve timing apparatus to maintain present valve timing during starting of the internal combustion engine before the actual valve timing computing unit becomes capable of computing the actual valve timing, wherein:

the valve timing controlling unit controls the variable valve timing apparatus such that the actual valve timing becomes target valve timing during the starting of the internal combustion engine after the actual valve timing computing unit becomes capable of computing the actual valve timing.

2. The control device according to claim 1, wherein:

the actual valve timing computing unit computes the actual valve timing based on an output signal, which is outputted by an external sensor that detects information associated with the actual valve timing.

3. The control device according to claim 2, wherein:

the internal combustion engine includes a camshaft and a crankshaft;

the variable valve timing apparatus changes the valve timing by changing a rotational phase of the camshaft with respect to the crankshaft; and the sensor is a cam angle sensor that outputs a cam angle signal synchronously with rotation of the camshaft.

4. The control device according to claim 1, wherein:

the actual valve timing computing unit computes, during the starting of the internal combustion engine in a present operation, the actual valve timing based on information, which is associated with the actual valve timing obtained during stopping of the internal combustion engine in a previous operation, and which is stored in a memory.

5. The control device according to claim 1, further comprising:

a reference timing computing unit that learns reference timing of the valve timing associated with the valve timing, wherein:

the actual valve timing computing unit computes the actual valve timing based on the learned reference timing.

6. The control device according to claim 5, wherein:

the actual valve timing computing unit computes the actual valve timing based on a predetermined temporary value of the reference timing before the reference timing computing unit learns the reference timing.

7. The control device according to claim 6, wherein the predetermined temporary value of the reference timing is a design target value of the reference position.

8. The control device according to claim 5, wherein the reference timing computing unit learns the reference timing after the starting of the internal combustion engine is completed.

9. A control device for controlling a variable valve timing apparatus that changes valve timing of at least one of an intake valve and an exhaust valve of an internal combustion engine, the control device comprising:

a sensor that outputs an output signal associated with actual valve timing;

a memory that is configured to store:

a first information item associated with the actual valve timing obtained during stopping of the engine; and a second information item associated with reference timing of the valve timing;

a valve timing computing unit that is configured to compute the valve timing based on the first information item stored in the memory during a first period that ranges from a time, at which the engine is started, to another time, at which the sensor starts outputting the output signal, wherein the valve timing computing unit is configured to compute the valve timing based on the second information item stored in the memory and the output signal during a second period, in which the sensor outputs the output signal; and a valve timing controlling unit that is configured to control the variable valve timing apparatus such that the valve timing computed by the valve timing computing unit becomes target valve timing, wherein:

in a case, where the first information item is not stored in the memory during the first period, the valve timing controlling unit controls the variable valve timing apparatus such that present valve timing is maintained.

10. The control device according to claim 9, wherein:

in a case, where the second information item is not stored in the memory during the second period, the valve timing computing unit computes the valve timing based on a temporary value of the reference timing and the output signal.

11. The control device according to claim 10, wherein:

the temporary value of the reference timing is a design target value of the reference timing.

12. The control device according to claim 9, further comprising:

a reference timing computing unit that is configured to compute the second information item, wherein the reference timing computing unit causes the memory to store the computed second information item.

13. The control device according to claim 12, wherein:

the reference timing computing unit computes the second information item after starting of the internal combustion engine has been completed during the second period.

14. The control device according to claim 9, wherein:

the internal combustion engine includes a crankshaft and a camshaft;

the variable valve timing apparatus changes the valve timing by changing a rotational phase of the camshaft relative to the crankshaft; and the sensor is a cam angle sensor that outputs a cam angle signal synchronously with rotation of the camshaft.

15. The control device according to claim 9, wherein:

the variable valve timing apparatus is driven by a motor.

16. The control device according to claim 9, wherein:

the first information item is the actual valve timing obtained during the stopping of the engine in a previous operation of the engine; and the valve timing computing unit computes the valve timing based on the first information item stored in the memory during the first period in a present operation.

17. A control device for controlling a variable valve timing apparatus that changes valve timing of at least one of an intake valve and an exhaust valve of an internal combustion engine, the control device comprising:

a valve timing computing unit that is configured to compute the valve timing based on a first information item stored in an external memory during a first period that ranges from a time, at which the engine is started, to another time, at which an external sensor starts outputting an output signal that is associated with actual valve timing, the first information being associated with actual valve timing obtained during stopping of the engine, wherein the valve timing computing unit is configured to compute the valve timing based on a second information item stored in the memory and the output signal outputted by the sensor during a second period, in which the sensor outputs the output signal, the second information item being associated with reference timing of the valve timing; and a valve timing controlling unit that is configured to control the variable valve timing apparatus such that the valve timing computed by the valve timing computing unit becomes target valve timing, wherein:

in a case, where the first information item is not stored in the memory during the first period, the valve timing controlling unit controls the variable valve timing apparatus such that present valve timing is maintained.

* * * * *